US006701689B2

(12) United States Patent
diGirolamo

(10) Patent No.: US 6,701,689 B2
(45) Date of Patent: Mar. 9, 2004

(54) STUD SPACER

(75) Inventor: Edward R. diGirolamo, Raleigh, NC (US)

(73) Assignee: The Steel Network, Inc., Raleigh, NC (US)

( * ) Notice: Subject to any disclaimer, the term of this patent is extended or adjusted under 35 U.S.C. 154(b) by 0 days.

(21) Appl. No.: 10/008,795

(22) Filed: Dec. 7, 2001

(65) Prior Publication Data

US 2003/0106280 A1 Jun. 12, 2003

(51) Int. Cl.[7] ..... E04H 1/00

(52) U.S. Cl. ..... 52/667; 52/739.1; 52/731.5; 52/731.9; 52/653.1; 52/243

(58) Field of Search ..... 52/667, 677, 712, 52/703, 733.2, 737.1, 739.1, 731.5, 731.9, 654.1, 653.1, 243, 317

(56) References Cited

U.S. PATENT DOCUMENTS 1,475,387 A * 11/1923 Holmes ..... 52/733.1
1,750,039 A * 3/1930 Feltes ..... 52/180
2,102,936 A * 12/1937 Bailey ..... 428/122
2,873,828 A * 2/1959 Zitomer ..... 52/667
4,018,020 A 4/1977 Sauer et al.
4,914,878 A * 4/1990 Tamaki et al. ..... 52/239
5,363,622 A * 11/1994 Sauer ..... 52/506.07
5,600,926 A * 2/1997 Ehrlich ..... 52/239
5,682,935 A * 11/1997 Bustamante ..... 144/144.51
5,784,850 A 7/1998 Elderson
5,899,041 A * 5/1999 Durin ..... 52/660
6,021,618 A 2/2000 Elderson
6,114,012 A * 9/2000 Amaoka et al. ..... 428/182

* cited by examiner

*Primary Examiner*—Carl D. Friedman
*Assistant Examiner*—Naoko Slack
(74) *Attorney, Agent, or Firm*—Coats & Bennett, P.L.L.C.

(57) ABSTRACT

A stud spacer for connecting and extending between studs within a stud wall structure. The stud spacer includes an elongated member having a series of curved shaped notches formed in the member with each notch being adapted to receive a portion of a stud such that the stud spacer effectively connects to and extends between respective studs.

29 Claims, 4 Drawing Sheets

STUD SPACER

FIELD OF THE INVENTION

The present invention relates to steel framing and particularly to steel wall construction and particularly to space bars used to extend between and connect studs.

BACKGROUND OF THE INVENTION

Generally, no metal walls are formed by automatically spacing and interconnecting a series of metal studs between upper and lower metal tracks. Typically the lower track is secured to a floor structure while the upper track is generally connected to an overhead structure. Wallboards or other types of interior wall materials are secured to the studs.

Loads placed on the studs from both the structure overhead (load-bearing) and wind or seismic (non-load-bearing) conditions will generally act as vertical and horizontal loads on the wall studs. These loads in most cases can result in damage to the studs and finishes if not properly braced.

The problem has been addressed in the past by providing lateral structural bracing elements to support studs in the weak direction. However, these bracing elements are relatively expensive and require significant labor to install.

In some cases, it is known to include spacer bars extending between the studs. However, many spacer bar designs require that the spacer bars be mechanically fastened by screws or weldment to the studs themselves. That, again, is labor intensive, time-consuming and in the end expensive. There have been attempts at providing a stud spacer bar that does not require mechanical fastening in the form of screws, fasteners or weldment. For example, see the disclosure found in U.S. Pat. No. 5,784,850.

SUMMARY OF THE INVENTION

The present invention entails a stud spacer for connecting to and extending between studs within a stud wall. The stud spacer includes an elongated member having a series of curved shaped notches formed in the member with each notch being adapted to receive a portion of a stud such that the stud spacer connects to and extends between respective studs.

In one exemplary embodiment, the elongated member includes a series of spaced apart generally S-shaped notches where the S-shaped notches receive portions of a respective stud. Further, in an exemplary embodiment, each S-shaped notch includes a pair of spaced apart edges with each edge including a curved node and wherein the curved nodes are offset with respect to each other.

Further, in another exemplary embodiment, the stud spacer of the present invention is incorporated into a wall structure including a series of spaced apart studs. In this embodiment, the stud spacer extends through a series of openings formed in the respective studs that form a part of the wall structure. The stud spacer engages, effectively connects, and spaces the respective studs. This is achieved by a series of curved shaped notches formed in the stud spacer. Particularly, the curved shaped notches are pressed into engagement with the studs such that a portion of the web of each stud projects into the curved shaped notches.

Other objects and advantages of the present invention will become apparent and obvious from a study of the following description and the accompanying drawings which are merely illustrative of such invention.

DESCRIPTION OF AN EXEMPLARY EMBODIMENT

Figure 1:
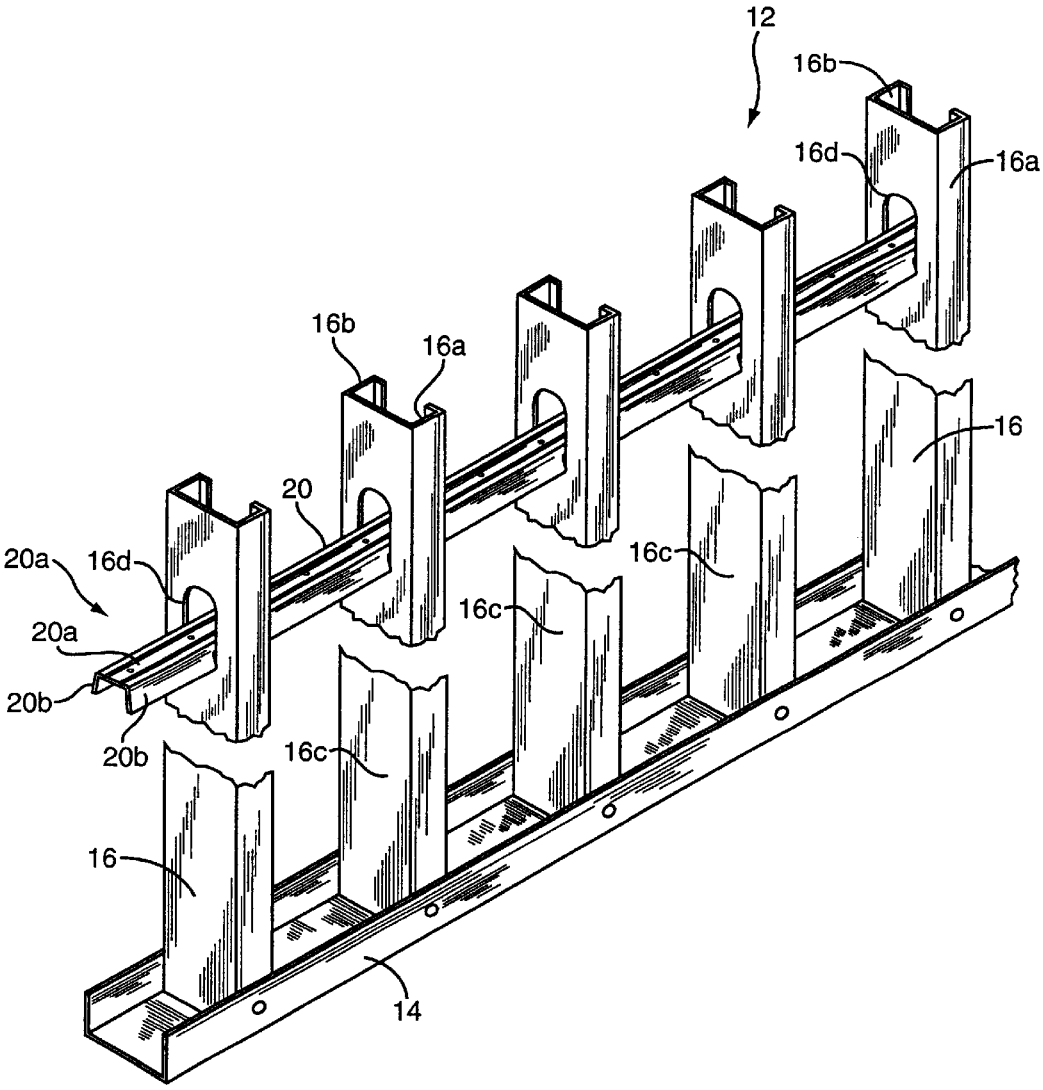
FIG. 1 is a perspective view of a portion of a wall structure showing the stud spacer of the present invention extending through a series of studs.

With further reference to the drawings, particularly FIG. 1, the stud spacer of the present invention is shown therein and indicated generally by the numeral 10. Stud spacer 10 basically comprises an elongated member that forms a part of a wall structure indicated generally in FIG. 1 by the numeral 12. Before discussing the stud spacer 10 in detail, a brief review of the wall structure 12 will follow. In that regard, wall structure 12 includes a lower track 14, an upper track (not shown), a series of spaced apart studs 16 and the stud spacer 10 engaged with the respective studs 16. Lower track 14 is adapted to receive and underlie the studs 16 and is typically secured to a floor structure. The upper track, on the other hand, overlies the studs 16 and connects thereto. Typically the upper track will be supported by one or more overhead joists or other type of overhead support structure.

Each stud 16 that form a part of the wall structure 12 includes a pair of flanges 16*a* and 16*b* and a central web 16*c*. As seen in the drawings, web 16*c* includes an opening 16*d*. As will be appreciated from subsequent portions of this disclosure, the stud spacer 10 in the exemplary embodiment disclosed herein extends through the openings 16*d* formed in the respective studs 16. In conventional fashion, wall boards in the form of dry wall or paneling are typically secured to the outside of the respective studs 16.

Turning to the stud spacer 10, it is seen that the same comprises an elongated member 20 that includes a central portion (web) 20*a* and a pair of sides (flanges) 20*b*. As seen in the drawings, the central portion 20*a* of the elongated member 20 includes a series of aligned openings and a pair of spaced apart reinforcing ribs. Further, the pair of sides 20*b* are angled slightly outwardly with respect to the central portion 20*a*.

Figure 2:
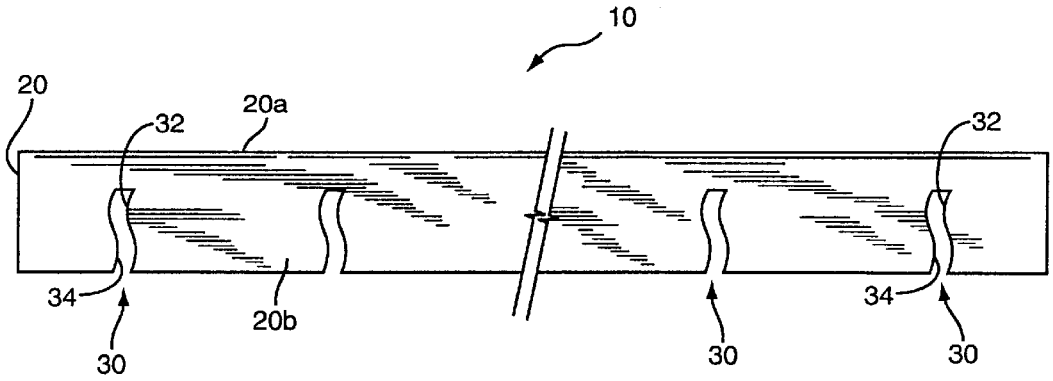
FIG. 2 is a side elevational view of the stud spacer of the present invention.
Figure 2A:
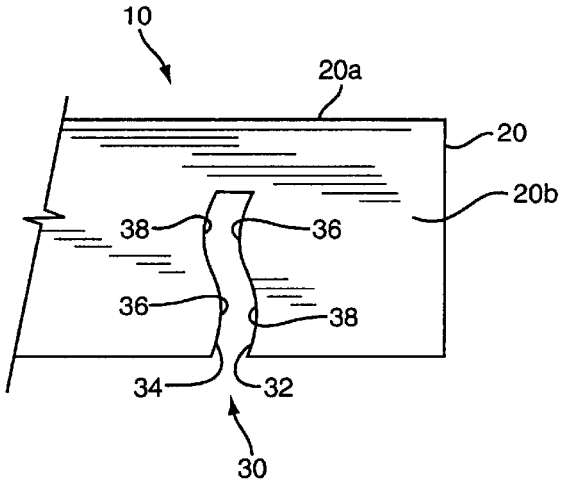
FIG. 2A is an enlarged fragmentary side elevational view of a portion of the stud spacer particularly illustrating the construction of a notch formed in the stud spacer.
Figure 3:
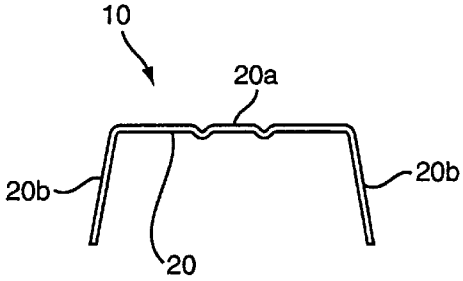
FIG. 3 is an end elevational view of the stud spacer.
Figure 4:
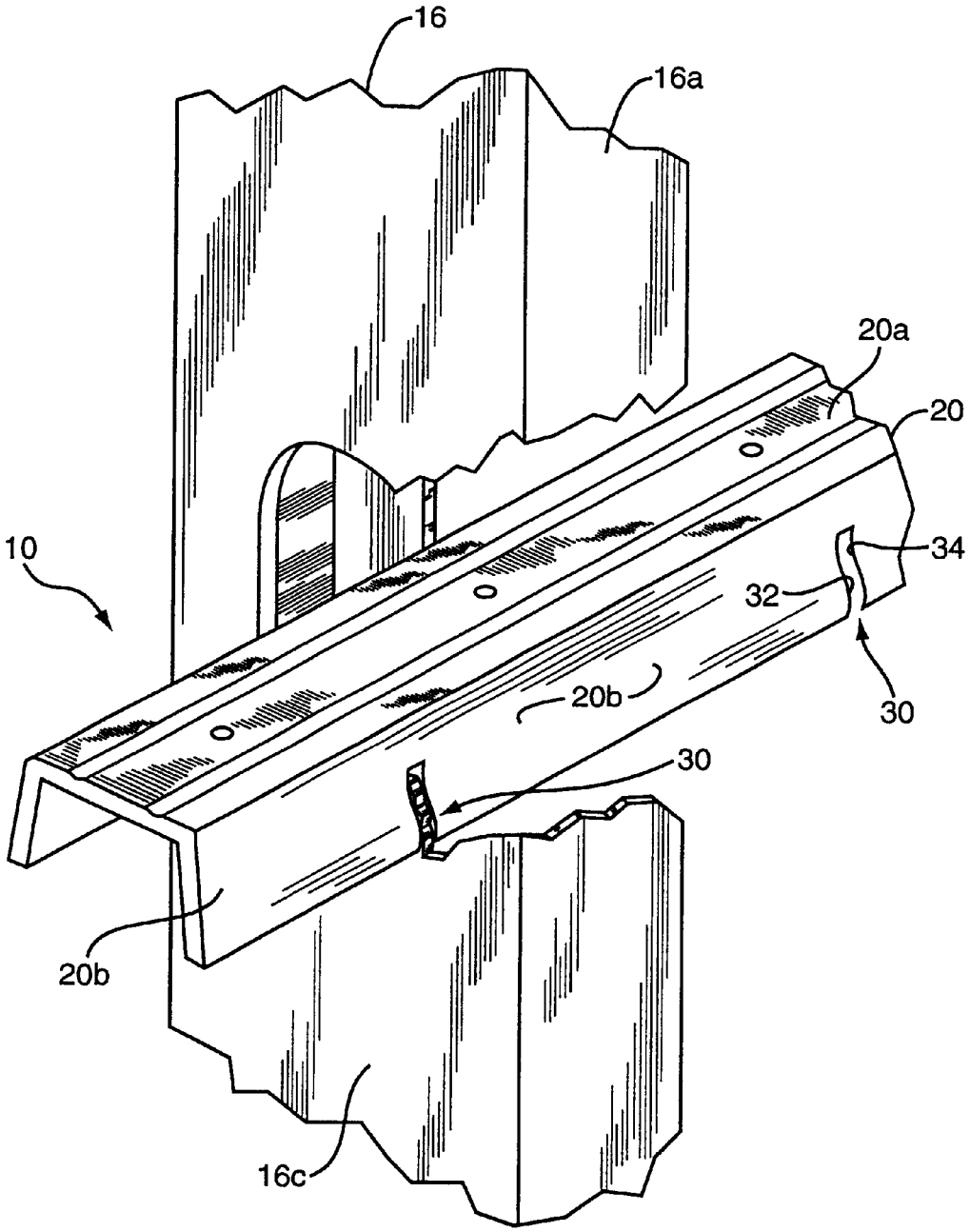
FIG. 4 is a fragmentary perspective view illustrating a web portion of a stud being projected into a curved shaped notch formed in the stud spacer.

Formed in each side 20*b* of the elongated member 20 is a series of curved shaped notches 30. See FIGS. 2 and 2A. Each curved shaped notch includes a pair of opposed edges 32 and 34. Formed on each curved shape edge 32 and 34 is a curved node or convex segment 36. As seen in the drawings, the curved nodes or convex segments 36 are offset such that in one orientation of the elongated member 20, one curved node 36 will be spaced above and offset with respect to the other curved node or convex segment. Also, formed on each edge 32 and 34 is a concave segment 38. Like the curved nodes 36, the concave segments 38 of each notch 30 are offset with respect to each other.

In use, the stud spacer 10 is extended through the openings 16*d* formed in a series of studs 16. As illustrated in the drawings, the elongated member 20 is pressed into engagement with the respective studs 16. More particularly, the curved shaped notches 30 formed in the sides 20*b* are aligned with the web 16*c* of the respective studs 16 and by pressing the elongated member 20 downwardly or towards the web, a portion of the web 16*c* is pushed or inserted into a respective curved shaped notch 30. It will be appreciated that the notches 30 are uniformly spaced along the sides 20*b* of the elongated member 20. Further, the notches 30 are disposed in corresponding pairs. That is, a notch formed in one side of the elongated member 20 is aligned with a notch formed in the other side. Thus, when the elongated member 20 is pressed downwardly on the web 16*c*, it follows that a portion of the web of a respective stud extends upwardly into the pair of corresponding notches 30.

Figure 5:
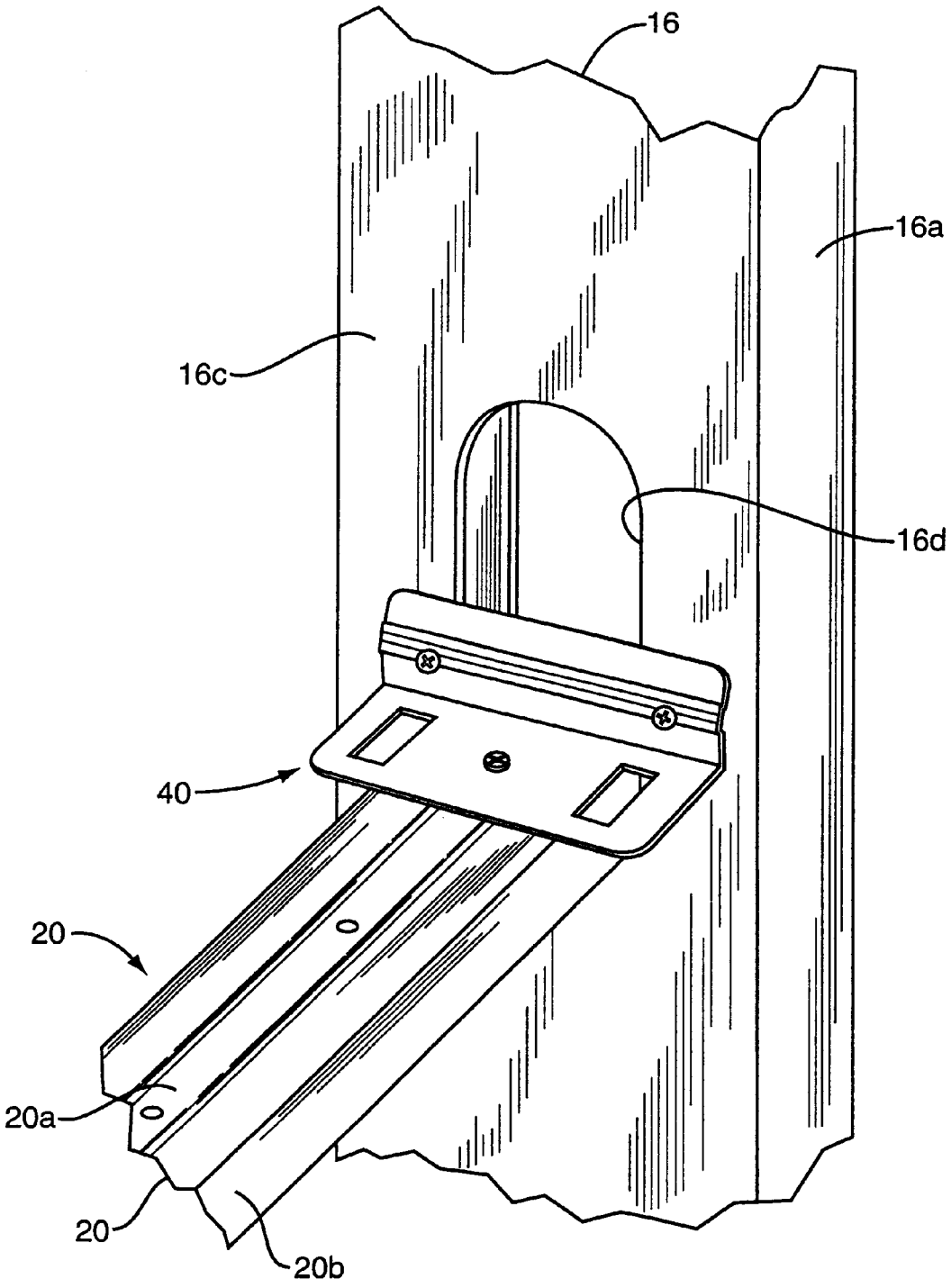
FIG. 5 is a fragmentary perspective view showing an alternative design wherein the stud spacer of the present invention is secured to a stud via a connecting clip.

The engagement of a portion of the web 16*c* with notches 30 is generally sufficient to secure the elongated member 20 to a respective stud 16. As will be understood by those skilled in the art, there is no requirement that the elongated member 20 be fastened to the respective studs 16 by screws, weldment or other fastener means. However, in some applications, it may be desirable to utilize a clip as an interface connector between the elongated member 20 and the respective studs 16. In this regard, reference is made to FIG. 5 that illustrates such an exemplary embodiment. Therein a clip 40 is shown connected by fasteners to both the stud 16 and the underlying elongated member 20. In this particular case, the clip 40 includes a pair of opposed flanges that extend down adjacent the sides 20*b* of the elongated member 20. However, it should be appreciated again that no clips are required in the case and even if a clip is optionally used, that various clip designs can be employed.

The stud spacer 10 may be constructed of various types of materials such as, for example, galvanized steel complying with ASTM A653. Typically, studs are spaced on 16 inch and 24 inch centers in metal wall construction. It is contemplated that in one exemplary embodiment of the present invention that the notches 30 would be spaced on 4 inch centers. Various lenghts of stud spacers can be provided. However, in one exemplary design the stud spacer 10 will extend 4 feet plus an appropriate amount for overlapment. In some situations a 3 inch overlapment is sufficient and therefore, in that case, the stud spacer would be approximately 51 inches long.

There are many advantages to the stud spacer 10 of the present invention. Among the advantages is that the stud spacer 10 tends to automatically adjust for various web thicknesses found in studs. While the dimensions of the curved shaped notch 30 can certainly vary and will vary depending on applications, it is contemplated that in one exemplary design that the width of the notch, that is the distance between edges 32 and 34 would be approximately 0.1180 inches. As viewed in FIG. 2A, the horizontal distance between the two curved nodes 36 of a respective notch would be approximately 0.020 inches. Therefore, it is appreciated that the notch 30 will tend to automatically adjust for various web thicknesses. That is, the height that the web extends into or projects into the notch 30 will vary depending upon the thickness of the web 16*c* of the stud 16. In some cases, the web 16*c* of the stud will project through substantially the entire height of the notch 30, while in other cases the web 16*c* may only project a relatively short distance into the notch 30. In any event, the elongated member 20 and the notches 30 formed thereon tend to easily seat about the web 16*c* of the respective studs 16. In most cases, one would not need a hammer or the like to pound the stud spacer 10 into engagement with the web 16*c*.

The stud spacer 10 of the present invention also automatically spaces the studs 16 during the construction of the wall structure 12. Thus, a great deal of time is not wasted laying out the studs in the wall structure. Further, the stud spacer 10 when engaged with the respective studs tends to prevent the studs from bowing and therefore improves wall hanging operations and the appearance of the completed wall. Further, the stud spacer 10 when connected between successive or adjacent studs causes the studs to resist rotation and displacement. In the end, the stud spacer of the present invention reduces labor costs and provides an economical and sturdy wall construction.

The present invention may, of course, be carried out in other specific ways than those herein set forth without departing from the scope and the essential characteristics of the invention. The present embodiments are therefore to be construed in all aspects as illustrative and not restrictive and all changes coming within the meaning and equivalency range of the appended claims are intended to be embraced therein.

What is claimed is:

1. A stud spacer for engaging and extending between studs within a stud wall, comprising:

an elongated member;

a series of spaced apart generally S-shaped notches formed in the elongated member for receiving portions of a stud such that when used in a wall structure the stud spacer extends between and is connected to consecutive studs.

2. The stud spacer of claim 1 wherein the elongated member includes opposing sides and wherein the generally S-shaped notches are spaced along each side.

3. The stud spacer of claim 2 wherein the S-shaped notches are laterally aligned such that they form opposing pairs along the elongated member.

4. A wall structure having a series of studs wherein the studs are interconnected by the elongated member of claim 1; and wherein each stud includes a web with an opening formed therein through which the elongated member extends and wherein a portion of the web of each stud projects into one or more of the S-shaped notches formed in the elongated member.

5. The stud spacer of claim 1 wherein each S-shaped notch includes a pair of spaced-apart edges with each edge including a curved node.

6. The stud spacer of claim 5 wherein the curved node of each notch are offset with respect to each other.

7. The stud spacer of claim 1 wherein each stud includes a web having opposed surfaces and wherein each S-shaped notch includes a pair of spaced-apart curved nodes, each node being adapted to engage a surface of the web.

8. The stud spacer of claim 7 wherein the curved nodes are offset with respect to each other.

9. The stud spacer of claim 7 wherein said elongated member includes a central portion and a pair of sides that extend from the central portion and wherein the series of spaced-apart generally S-shaped notches are formed in the sides of the elongated member.

10. The stud spacer of claim 1 wherein each notch includes opposed runs with each run including a concave portion and a convex portion.

11. The stud spacer of claim 1 wherein each notch includes a pair of concave portions and a pair of convex portions.

12. The stud spacer of claim 11 wherein the convex portions are offset with respect to each other.

13. The stud spacer of claim 12 wherein the concave portions are offset with respect to each other.

14. The stud spacer of claim 1 wherein the elongated member includes a web and a pair of flanges extending from the web.

15. The stud spacer of claim 14 wherein at least one of the flanges is flared outwardly relative to the web so as to form an angle greater than 90° with the web.

16. A stud spacer for connecting to and extending between studs within a stud wall comprising:

a member;

a series of curved shaped notches formed in the member with each notch being adapted to receive a portion of a stud such that the stud spacer may connect to and extend between respective studs;

each curved shaped notch having a length and a pair of opposed edges that extend in general parallel relationship to each other over a substantial portion of the length of the notch; and wherein each edge includes a curved node.

17. The stud spacer of claim 16 wherein the length of the notch is greater than the distance between the two edges.

18. The stud spacer of claim 16 wherein the curved nodes are offset with respect to each other.

19. The stud spacer of claim 18 wherein each edge of the curved shaped notch includes convex portions and wherein the convex portions are offset with respect to each other.

20. The stud spacer of claim 16 wherein the member includes a central portion and a pair of sides that project from the central portion with each side projecting at least slightly outward with respect to the central portion.

21. A method of connecting studs within a stud wall comprising:

extending a stud spacer through openings formed within at least two studs that form a part of the stud wall; and inserting a portion of each stud into a curved shaped notch formed in the stud spacer such that the stud spacer is connected between the two studs, the curved shaped notch having a length and a pair of opposed edges that extend in general parallel relationship to each other over a substantial portion of the length of the notch.

22. The method of claim 21 wherein each stud includes a web portion and wherein the openings are formed in the web portion of the studs; and wherein the web portion of the studs are projected into the curved shaped notches formed in the stud spacer.

23. The method of claim 22 wherein each curved shaped notch assumes a generally S-shaped configuration.

24. The method of claim 21 wherein each curved shaped notch includes a pair of spaced apart edges and wherein each edge includes a concave portion and a convex portion.

25. The method of claim 24 wherein the concave portions of each notch are offset with respect to each other and wherein the convex portions of each notch are offset with respect to each other.

26. A wall having a series of spaced apart studs with each stud having a web portion and an opening formed therein; a stud spacer for connecting to and extending between the studs and including a member and a series of curved shaped notches formed in the member with each notch being adapted to receive a portion of a stud such that the stud spacer may connect to and extend between respective studs; and wherein each stud spacer projects through the openings within at least two studs and wherein portions of the webs of at least two studs extend into the curved shaped notches of the stud spacer.

27. The wall of claim 26 wherein the member includes a central portion and a pair of sides and wherein the curved shaped notches are formed in the sides of the member.

28. The wall of claim 27 wherein the sides of the member having the curved shaped notches formed therein project at least slightly outwardly with respect to the central portion of the member.

29. The wall structure of claim 26 including a series of clips with each clip being interconnected between the member and a respective stud.

* * * * *